US005181841A

United States Patent [19]

Kirkland

[11] Patent Number: 5,181,841

[45] Date of Patent: Jan. 26, 1993

[54] SEWAGE PUMP

[75] Inventor: Dan R. Kirkland, Fort Wayne, Ind.

[73] Assignee: Wayne/Scott Fetzer Company, Fort Wayne, Ind.

[21] Appl. No.: 803,144

[22] Filed: Dec. 5, 1991

Related U.S. Application Data

[62] Division of Ser. No. 566,050, Aug. 10, 1990, Pat. No. 5,145,337.

[51] Int. Cl.[5] ..... F04B 35/04; F04B 3/10

[52] U.S. Cl. ..... 417/423.3; 415/225

[58] Field of Search ..... 415/225, 182.1, 200, 415/121.2, 88; 417/423.3, 423.8, 423.14, 424.1

[56] References Cited

U.S. PATENT DOCUMENTS

| | | | |
|---|---|---|---|
| 2,320,708 | 6/1943 | Yost . | |
| 2,528,210 | 10/1950 | Stewart | 415/200 |
| 3,291,473 | 12/1966 | Sweeney et al. | 415/88 |
| 3,685,926 | 8/1972 | Blum | 417/424 |
| 3,746,472 | 7/1973 | Rupp | 415/175 |
| 3,790,312 | 2/1974 | Bottoms | 417/423.14 |
| 3,814,551 | 6/1974 | Weis | 415/225 |
| 3,999,890 | 12/1976 | Niedermeyer | 417/17 |
| 4,052,133 | 10/1977 | Yeater | 415/200 |
| 4,208,171 | 6/1980 | Jonsson | 417/40 |
| 4,275,995 | 6/1981 | Taylor | 417/40 |
| 4,626,175 | 12/1986 | Riback et al. | 417/40 |
| 4,644,202 | 2/1987 | Kroy et al. | 417/370 |
| 4,786,230 | 11/1988 | Thut | 415/200 |
| 4,806,083 | 2/1989 | LaGrange et al. | 417/423.14 |
| 4,810,174 | 3/1989 | Stuckey et al. | 417/423.14 |
| 5,055,000 | 10/1991 | Akhter | 417/40 |
| 5,061,157 | 10/1991 | Arakawa | 417/423.14 |

*Primary Examiner*—Richard A. Bertsch
*Assistant Examiner*—Alfred Basichas
*Attorney, Agent, or Firm*—George Pappas

[57] ABSTRACT

A sewage pump includes an injection molded thermoplastic upper housing that surrounds an electric motor and its cast iron motor support, except for the bottom wall of the motor support which forms one wall of a vortex volute, the remainder of the volute being constructed of injection molded thermoplastic. The volute includes an inlet aperture through the bottom, and integrally molded legs extending downwardly whose length is related to the diameter of the inlet aperture such that the clearance underneath the volute is less than the diameter of the solids that will pass through the inlet aperture. This prevents oversized solids from reaching the inlet aperture. The outlet of the volute terminates in an annular thermoplastic threaded connection that is threaded on both the interior and exterior for fitting to different sized effluent pipes. The volute can be resized with a solids restricter in the inlet aperture, and by cutting off the legs to a new length selected in relation to the size of solids that the solids restricter will pass into the inlet aperture, to maintain the oversized solids blocking effect.

3 Claims, 1 Drawing Sheet

SEWAGE PUMP

This is a division of copending application Ser. No. 07/566,050, filed on Aug. 10, 1990.

BACKGROUND OF THE INVENTION

The present invention relates generally to non-positive displacement fluid pumps, and more particularly to submersible sewage pumps.

Submersible sewage pumps are generally located at the bottom of a septic tank or other receptacle in which sewage comprising mostly water and occasional solids is received. Such pumps generally operate intermittently under automatic control, such as by float actuated switches or other water level sensors. The intake of the pump is usually located quite near the floor of the septic tank, since it is desirable to pump out the sewage down to the lowest level possible. Unfortunately, the solids content of the sewage is also predominantly located near the floor of the septic tank and the pump intake. The pump is therefore susceptible to blockage or damage if solids that are too large should enter the pump intake. For this reason, measures to screen out oversized solids are desirable. One way of preventing the entry of oversized solids is to place the inlet aperture of the pump on the underside of the pump volute, and then support the volute above the floor of the septic tank on legs that are short enough to preclude passage underneath the volute of solids too large to pass safely through the pump inlet. Since sewage pumps are sometimes offered by the manufacturer in a range of solids pumping capacities to suit the application, in the past it has been necessary to manufacture a different volute for each size pump in order to incorporate variations in the size of the inlet aperture and a corresponding change in the length of the support legs to screen out solids larger than a selected maximum size. It would be desirable and advantageous with respect to cost to provide a range of pumps of different solids pumping capacities that all use a single common volute part. The present invention provides this desirable advantage.

In the past, the housings of sewage pumps have often been made of cast iron which is relatively durable and somewhat resistant to the corrosive effects of constant exposure to sewage. Nevertheless, cast iron can be corroded to an undesirable extent by sewage, which can lead to failure of the pump or, at the very least, make difficult the disassembly of the pump for maintenance or repair. Cast iron is also heavy and increases the cost of transportation of the manufactured pumps, and makes the pumps somewhat unwieldy to handle, especially in the larger sizes. Consequently, some manufacturers have attempted to replace some of the parts of their sewage pumps that were formerly cast iron with parts made of plastic. Suitable plastics are lighter than cast iron and less susceptible to chemical attack by corrosive sewage. Since plastic is less conductive of heat than cast iron, however, it has heretofore been the practice to leave at least one of the major external components of the pump housing, such as the volute, constructed of cast iron in order to provided a path for heat to be conducted from the encased electric motor to the sewage water. It would be desirable and advantageous to construct the entire externally exposed portion of the pump of plastic in order to reduce weight and present a non-corrodible exterior, while maintaining sufficient cooling of the electric motor. The present invention provides this desirable advantage.

Sewage pumps are sometimes provided with a threaded outlet to facilitate the connection of a waste pipe to the pump to carry away the effluent. In the past, with the outlet formed of cast iron, the threads have been placed on the inside of the outlet or on the outside, but not on both the inside and the outside. It would be difficult to thread a cast iron outlet on both the inside and outside and maintain a desirable limit on the difference between the inside and outside diameters. Generally, cast iron would require an undesirably great wall thickness. Thus, the sewage pumps as manufactured in the past have fit only a single size of threaded pipe. In field installations, it is sometimes preferable to be presented with a choice of pipe sizes that can be used for connection to the pump outlet. It would be desirable and advantageous to provide a sewage pump that permits connection of its outlet to either one of two pipe sizes. The present invention provides this desirable advantage.

SUMMARY OF THE INVENTION

The present invention, according to one aspect thereof, pertains to a sewage pump including an upper housing having an electric motor mounted therein with a rotary shaft extending therefrom. A volute is mounted to the upper housing, and includes an inlet aperture and a pump outlet. The pump outlet terminates in an annular threaded connection having internal threads and external threads, whereby the annular threaded connection can be engaged with one of two alternatively selectable outlet pipes of different sizes. One of the outlet pipes has external threads corresponding to the internal threads of the annular threaded connection and the other of the outlet pipes has internal threads corresponding to the external threads of the annular threaded connection. The pump volute, including the annular threaded connection, is constructed of plastic. An impeller is rotatably mounted in the volute and connected to the rotary shaft of the electric motor for rotation therewith to generate a flow in the volute to draw sewage in through the inlet aperture and expel sewage through the pump outlet.

In accordance with another aspect of the invention, a sewage pump includes an electric motor including a field portion, a rotor, and a shaft extending from the rotor. A metal motor support includes a bottom wall, an annularly disposed portion upstanding from the bottom wall and engaging and supporting the field portion of the electric motor, and a central portion having a bore therethrough receiving and supporting the shaft for rotation therein, wherein the shaft extends through the bottom wall. A plastic upper housing covers the electric motor entirely and covers the metal motor support except for the bottom wall thereof. A plastic volute has an axial inlet aperture aligned with the shaft of the electric motor, and a tangential outlet passage terminating in a pump outlet. The volute is in fluid flow communication with the exposed bottom wall of the motor support. An impeller is disposed within the volute below the bottom wall of the motor mount and mounted to the shaft for rotation therewith. Heat generated by the electric motor is conducted therefrom through the metal motor mount and dissipated by the bottom wall of the motor mount into fluid within the volute that flows across the bottom wall under the influence of the impeller.

Another aspect of the present invention pertains to a method of resizing a volute for a sewage pump. A volute is provided for a sewage pump that has at least a portion that is molded as an integral piece including a bottom, an inlet aperture through said bottom, and a plurality of legs extending from said bottom. The inlet aperture has a diameter and the legs have a length wherein the length of the legs is related to the diameter of the inlet aperture such that a solid object that is small enough to pass beneath the bottom of the volute when the legs are resting on a flat surface can also pass through the diameter of the inlet aperture. A sprue is molded with the volute that partially occludes the inlet aperture to restrict the size of solid object that can pass through the inlet aperture. The volute can be resized one way by leaving the sprue in the inlet aperture and cutting off the legs to a new length related to the diameter of a solid object that is small enough to pass through the inlet aperture as restricted by the sprue, such that a solid object that can pass beneath the bottom of the volute when the legs having the new length are resting on a flat surface can also pass through the inlet aperture and sprue. The volute can be resized another way by removing the sprue from the inlet aperture and leaving the legs at their originally molded length.

Considering yet another aspect of the present invention, a method of constructing a volute for a sewage pump involves molding at least a portion of the volute as an integral piece including a bottom, an inlet aperture through the bottom, and a plurality of legs extending from the bottom, with the inlet aperture having a diameter and the legs having a length wherein the length of the legs is related to the diameter of the inlet aperture such that a solid object that is small enough to pass beneath the bottom of the volute when the legs are resting on a flat surface can also pass through the inlet aperture. The volute is resized by inserting an annular reducer in the inlet aperture to reduce the diameter thereof to a new diameter, and by cutting off the legs to a new length related to the new diameter of the inlet aperture such that a solid object that is small enough to pass beneath the bottom of the volute when the legs having the new length are resting on a flat surface can also pass through the inlet aperture in which the annular reducer is received.

It is an object of the present invention to provide for the manufacture of a range of pumps of different solids pumping capacities that all use a single common volute to reduce manufacturing cost.

It is another object of the present invention to construct the entire externally exposed portion of the pump of plastic in order to reduce weight and present a non-corrodible exterior, while still maintaining sufficient cooling of the electric motor.

It is yet a further object of the present invention to provide a pump that permits connection of its outlet to either one of two pipe sizes.

Additional objects and advantages of the present invention will be apparent from the following descriptions of the invention in terms of a preferred embodiment with reference to the drawings.

DETAILED DESCRIPTION OF THE PREFERRED EMBODIMENT

Figure 1:
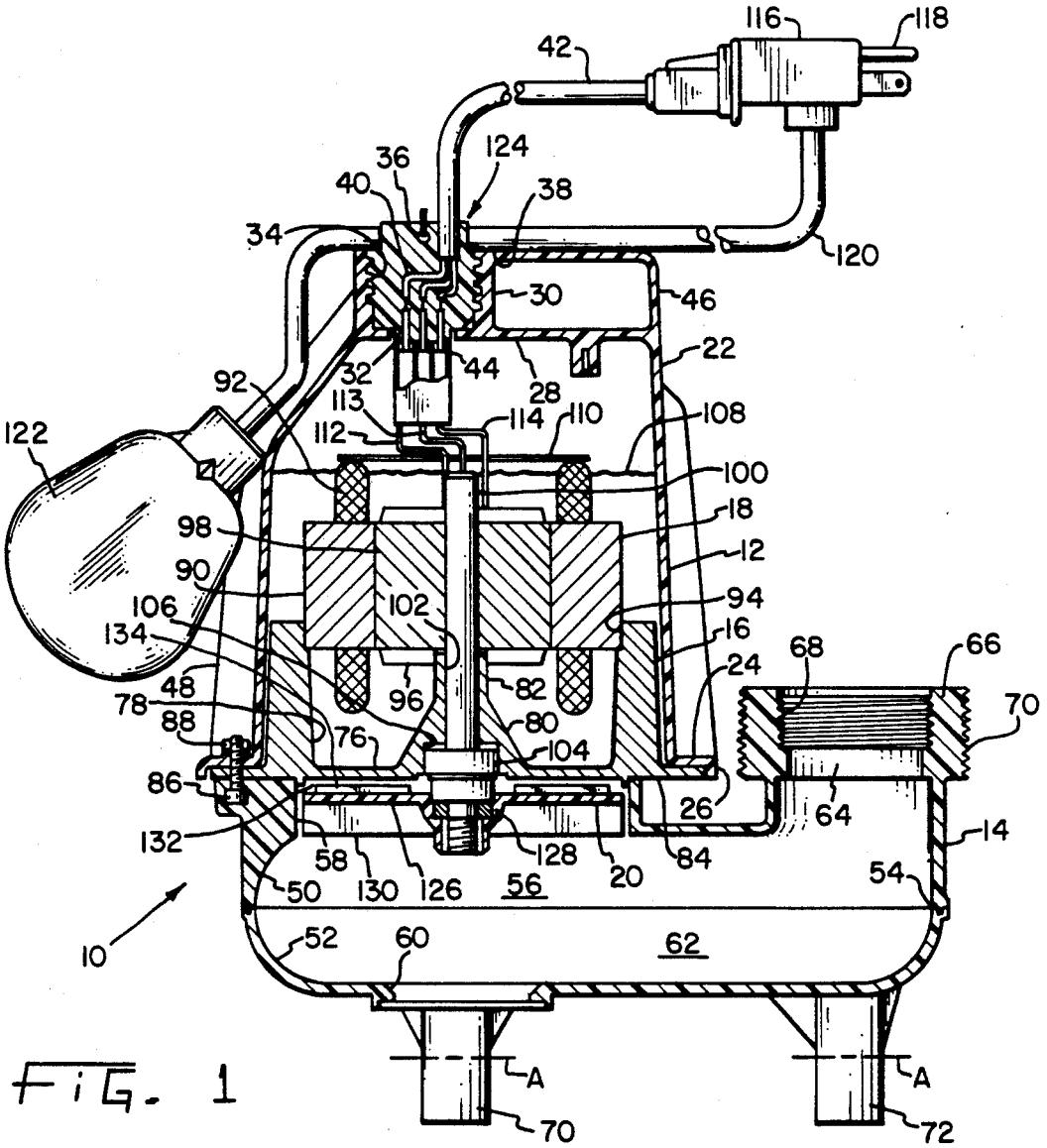
FIG. 1 is a vertical sectional view of a sewage pump in accordance with the present invention taken along section line 1—1 of FIG. 2, and viewed in the direction of the arrows.
Figure 2:
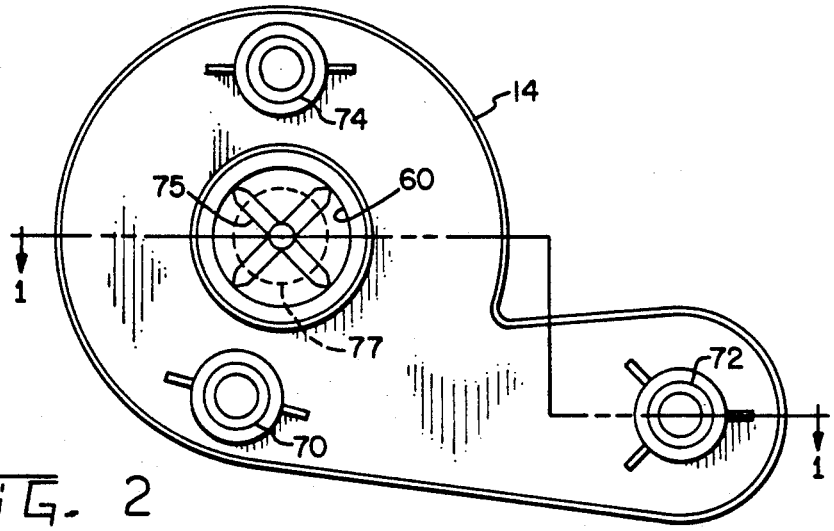
FIG. 2 is a bottom view of the sewage pump of FIG. 1.

Referring to FIGS. 1 and 2, there is illustrated a sewage pump 10 constructed in accordance with the present invention. Pump 10 includes as its main components an upper housing 12, a volute 14, a motor support 16, an electric motor 18, and an impeller 20.

Upper housing 12 comprises an open-bottom shell constructed of injection molded thermoplastic, preferably 30% glass filled polypropylene. This material is lightweight, strong, and resistant to the corrosive effects of sewage, and entirely covers motor support 16 and electric motor 18, except for the bottom surface of the bottom wall of motor support 16, which is described further below. Upper housing 12 has a generally cylindrical sidewall 22 and a radial flange 24 extending outwardly from sidewall 22 proximate the open bottom thereof. A downturned annular lip 26 extends from the outer edge of radial flange 24 toward volute 14. Upper housing 12 further includes a top wall 28 closing the top end thereof. Top wall 28 has an annular collar 30 upstanding therefrom that surrounds an aperture 32 in top wall 28. Collar 30 is open at the top end thereof and includes internal threads 34. Received within collar 30 is an electrical connector 36 that includes external threads 38 that correspond to and are received by internal threads 34. A connector 36 having external threads 38 is received within collar 30, with external threads 38 cooperatively engaging internal threads 34. Embedded within connector 36 are three electrical leads 40 electrically connected with a three-conductor cable 42 that extends externally of upper housing 12. Electrical leads 40 terminate in three electrical terminals 44 that project from connector 36 through aperture 32 into the interior of upper housing 12. Connector 36 engages aperture 32 and hermetically seals upper housing 12 at aperture 32. Upper housing 12 further includes an integral carrying handle 46 extending between collar 30 and sidewall 22 above top wall 28, and a plurality of longitudinal reinforcing ribs 48 extending radially outwardly along sidewall 22 and connecting with radial flange 24.

Volute 14 is constructed of injection molded thermoplastic, preferably 20% glass filled ABS. This material is lightweight, strong, and resistant to the corrosive action of sewage. Together with upper housing 12, volute 14 covers the metal portions of sewage pump 10, namely motor support 16 and electric motor 18, such that pump 10 presents an external surface that is plastic rather than metal. The only substantial amount of metal that is exposed to sewage is the bottom surface of the bottom wall of motor support 16, and that exposure takes place within volute 14, rather than on the outside of pump 10. The relatively small exposed metal surface of motor support 16 is for the purpose of heat dissipation from motor 18, as discussed further below. Volute 14 is comprised of an upper portion 50 and a lower portion 52 sealed together along joint 54. Upper portion 50 defines the upper part of a vortex chamber 56, and also defines a cylindrical impeller chamber 58 extending upwardly from vortex chamber 56 in communication therewith. Lower portion 52 defines the lower part of vortex chamber 56, and includes an inlet aperture 60 in communication with and axially aligned with vortex chamber 56 and impeller chamber 58. A tangential outlet passage 62 is defined between upper portion 50 and lower portion 52 of volute 14 and extends tangentially from vortex chamber 56 laterally therefrom in the horizontal direction. Tangential outlet passage 62 communicates with pump outlet 64 which opens upwardly at one side of upper housing 22. Pump outlet 64 is defined by upper portion 50 of volute 14, and includes an annular threaded connection 66 disposed about outlet 64. Threaded connection 66 includes inner threads 68 and outer threads 70 formed on the inner and outer circumferential surfaces thereof, respectively. Molded integrally with lower portion 52 of volute 14 are three support legs 70, 72 and 74 that extend downwardly from the bottom wall of lower portion 52 to support volute 14 above the floor of the septic tank or other sewage receptacle in which sewage pump 10 is located. During operation of sewage pump 10, sewage water is drawn underneath volute 14 in the space defined between the bottom of lower portion 52 and the floor of the septic tank. The height of that space is determined by the length of each of the legs 70, 72 and 74. After being drawn under volute 14, the sewage water is then sucked into volute 14 through inlet aperture 60, and is thereafter expelled through outlet passage 62 and through pump outlet 64.

One potential problem with sewage pumps that sit on the floor of a septic tank is that the solid debris that is picked up from the tank floor and sucked into the pump inlet can cause damage to or clogging of the pump if the solids are too large. One way to prevent such a problem is to size the inlet aperture 60 appropriately so that any solid object that is small enough to pass through aperture 60 is also small enough to pass through volute 14 without causing damage or becoming stuck. With only this measure taken, however, it is still possible that a large solid object that is too large to pass through inlet aperture 60 would nevertheless become lodged in aperture 60, or on the outside thereof, thereby blocking the flow of water through aperture 60 and causing the sewage pump 10 to malfunction. To prevent such an occurrence, the length of legs 70, 72 and 74 are selected in relation to the size of the solids that inlet aperture 60 will pass, such that the clearance between the bottom of lower portion 52 of volute 14 and the floor of the tank is insufficient to admit any solid object large enough to potentially block inlet aperture 60. Thus, large solid objects in the vicinity of sewage pump 10 are trapped at the outside periphery of volute 14 and are not permitted to be sucked underneath volute 14 where they could potentially cause problems at inlet aperture 60. The length of legs 70, 72, and 74 is less than the diameter of the maximum sized solid that will pass through inlet aperture 60.

Sewage pumps are manufactured in a variety of solids pumping capacities to suit different applications. For example, an effluent pump may be designed to pump primarily the liquid portion of the sewage to, for instance, a tile percolation field, where the pumping of large solids is quite undesirable. On the other hand, a sewage pump that is designed to pump sewage to a municipal sewer line is intended to pump large solids. It has in the past been common practice to manufacture differently sized volutes for each of the various solids pumping capacities. This increases the cost of each pump since it is more costly to manufacture several different volutes than to manufacture only one size. In order to alleviate this cost disadvantage of manufacturing many different volutes, the present invention contemplates providing a variety of pumps of different solids pumping capacities while utilizing only a single molded volute. In practice, the single volute to be manufactured is molded with the inlet aperture 60 having a diameter and the legs 70, 72 and 74 having a length appropriate for the largest capacity pump to be constructed from the volute. Pumps of lesser capacity are provided for by integrally casting a cross-shaped sprue 75 in inlet aperture 60 to reduce the size of solids that can be passed therethrough. Then, to maintain the solids restraining function of the clearance below volute 14, each of the legs 70, 72 and 74 of the common volute casting is cut off (along lines A, FIG. 1) to a length appropriate to the reduced size of solids that can pass through inlet 60 with sprue 75 left in place. It is less expensive to manufacture a single volute casting with the legs cast integrally therewith to the maximum length, and then subsequently cut off the legs to shorten them, than it would be to manufacture separate castings for each pump size with custom-length legs cast integrally therewith. By constructing the volute of injection-molded thermoplastic, the legs can be cut off quite easily as compared to cast iron. Where it is desired to utilize the maximum solids handling capacity of the pump, legs 70, 72 and 74 are left at their originally cast length, and sprue 75 is cut out, exposing the full diameter of inlet aperture 60.

An alternative embodiment of means for restricting the maximum size of solids that pass through aperture 60 involves molding the volute with an annular reducing ring 77 disposed within aperture 60 and attached thereto by an annular score line of reduced thickness. For the smaller capacity pump, the annular reducing ring 77 would be left in place and the legs 70, 72 and 74 would be cut off to the appropriate length. For the larger capacity pump, the annular reducing ring 77 would be removed and legs 70, 72 and 74 would remain unaltered.

In yet another embodiment, reducing ring 77 would be molded separately from the volute, and would be inserted in inlet aperture 60 for the smaller capacity pump.

Motor support 16 is attached to upper portion 50 of volute 14 adjacent impeller chamber 58 and defines the top wall thereof. Motor support 16 is constructed of cast iron and includes a generally planar bottom wall 76, an upstanding annular wall 78 extending upwardly from bottom wall 76, and a central frusto-conical portion 80 extending upwardly from bottom wall 76 and centered with respect to annular wall 78 in the horizontal plane. Extending upwardly from the top of frusto-conical portion 80 is a cylindrical portion 82. Bottom wall 76 extends radially outwardly beyond annular wall 78 to form annular flange 84. Annular flange 84 is sandwiched between upper portion 50 of volute 14 and flange 24 of upper housing 12. A series of peripherally spaced bolts 86 having their heads embedded in the upper peripheral region of upper portion 50 of volute 14 are received through correspondingly spaced holes in annular flange 84 of motor support 16 and in flange 24 of upper housing 12. Corresponding nuts 88 are received on the free ends of bolts 86 and compress flange 24 against annular flange 84, and flange 84 against upper portion 50 of volute 14. A hermetic seal is effected at the juncture of flange 24 of upper housing 12 and annular flange 84 of motor support 16. Bottom wall 76 of motor support 16 therefore effectively closes and seals the bottom open end of upper housing 12.

Electric motor 18 is a an induction motor of the shaded pole type and includes annular field laminations 90 in which a magnetic field is established by electrical current passing through field windings 92. Field laminations 90 engage and are supported by annular wall 78 of motor support 16. More specifically, field laminations 90 are received in an annular groove 94 in the inner surface of upstanding annular wall 78 of motor support 16. Annular groove 94 intersects the top surface of annular wall 78, such that field windings 90 are received into groove 94 by sliding axially from above. Annular groove 94 is sized with a diameter selected to provide a press-fit interference between annular wall 78 and field laminations 90 to hold field laminations 90 in place within upper housing 12. Disposed concentrically within field laminations 90 is induction rotor 96. An annular gap 98 provides clearance between field laminations 90 and rotor 96 to enable free rotation of rotor 96. Rotor 96 includes an output shaft 100 fixed thereto that extends downwardly and is rotatably received in a bore 102 in frusto-conical portion 80 and cylindrical portion 82 of motor support 16. Shaft 100 is unsupported at its upper end and thus rotor 96 relies upon the length of bore 102 acting upon the lower portion of shaft 100 to provide lateral support to maintain rotor 96 centered within field laminations 90. A thrust bearing and oil seal 104 is received in a counter bore 106 in the bottom of motor support 16 that is coaxially aligned with bore 102. Bearing/seal 104 provides vertical support for shaft 100 and rotor 96, and hermetically seals the opening through bottom wall 76 of motor support 16 created by bores 102 and 106. The interior of upper housing 12 is therefore able to be filled with oil to a level 108 that submerges electric motor 18, without there being any pathway through which such oil could ordinarily exit. The oil in upper housing 12 serves to lubricate motor 18, as well as assist in the transfer of heat from motor 18 to motor support 16, where the heat is then dissipated through bottom wall 76 of motor support 18 to the sewage water immediately therebelow located above impeller 20 and communicating with vortex chamber 56 of volute 14. Located atop field windings 92 is a non-conductive paper plate 110 through which conductors 112, 113 and 114 pass via apertures therein. Plate 110 serves as a guide for the conductors to prevent them from shifting position and possibly coming into contact with rotor 96. Each of the conductors 112, 113 and 114 is electrically connected at one end to electrical terminals 44 and at the other end to field windings 92 of motor 18.

Conductors 112–114 continue electrically through electrical leads 40 and cable 42 to electrical plug 116, and eventually connect therethrough to plug terminals 118. Prior to connecting to terminals 118, however, the hot side conductor from cable 42 is first routed through cable 120 to float bulb 122, where the conductor is connected to a mercury switch located inside float bulb 122 that is sensitive to orientation. The mercury switch is wired in series with the hot conductor, which thus returns through cable 120 to plug 116 and is connected to the hot terminal of plug terminals 118. Cable 120 is mechanically, but not electrically, connected to upper housing 12 at location 124. Between connection location 124 and bulb 122, cable 120 is free to flex, limited only by the flexibility of the sheath materials and the enclosed conductors. Generally, as the water level in the tank in which sewage pump 10 is located rises, bulb 122 is buoyed up and the section of cable 120 between bulb 122 and location 124 acts somewhat like a lever, albeit a flexible one, pivoted approximately at location 124. Thus, as bulb 122 rises, it also simultaneously rotates about a horizontal axis perpendicular to cable 120. This rotary change of orientation of bulb 122 tends to cause the mercury switch located therein to close when the bulb has rotated to an orientation corresponding to the desired high-water turn on level for pump 10. Thus, the electrical circuit is completed and power flows from plug terminals 118 to motor 18. As the water level lowers due to the pumping action of sewage pump 10, the bulb 122 lowers and rotates to an orientation in which the mercury switch opens, thus turning off motor 18.

Impeller 20 is constructed of injection molded plastic, preferably 20% glass filled ABS, and includes a disk portion 126 having a threaded brass insert 128 embedded therein, with brass insert 128 being threadedly received on a correspondingly threaded portion of the lower end of output shaft 100. A plurality of vanes 130 extend downwardly from disk 126 in axial direction, and also extend generally radially. Vanes 130 serve to cause sewage water located therebelow in vortex chamber 56 to be rotated, thereby setting up a vortex flow which draws sewage water in through inlet aperture 60 and expels it tangentially through tangential outlet passage 62 and pump outlet 64. Vanes 130 are confined within impeller chamber and do not protrude into vortex chamber 56. Thus, solids that enter inlet aperture 60 are accelerated and expelled by the vortex flow without danger of being caught in the vanes of the impeller. A disk shaped fluid gap 132 is defined between disk 126 and the bottom wall 76 of motor support 16. Within the fluid gap 132, which communicates with vortex chamber 56 at the periphery of disk 126, sewage water is circulated by the action of a plurality of radial ribs 132 integrally molded with disk 126 on the top surface thereof. This circulation of water in fluid gap 132 aids in the dissipation of heat from motor support 16, and thus from motor 18.

What is claimed is:

1. A method of resizing a volute for a sewage pump comprising the steps of:

a) providing a volute for a sewage pump having at least a portion that is molded as an integral piece including a bottom, an inlet aperture through said bottom, and a plurality of legs extending from said bottom, said inlet aperture having a diameter and said legs having a length wherein the length of said legs is related to the diameter of said inlet aperture such that a solid object that is small enough to pass beneath the bottom of said volute when said legs are resting on a flat surface can also pass through the diameter of said inlet aperture; and further including a sprue molded with said volute that partially occludes said inlet aperture to restrict the size of solid object that can pass through said inlet aperture;

b) removing said sprue from said inlet aperture; and c) leaving said legs at originally molded lengths.

2. A method of resizing a volute for a sewage pump comprising the steps of:

a) providing a volute for a sewage pump having at least a portion that is molded as an integral piece including a bottom, an inlet aperture through said bottom, and a plurality of legs extending from said bottom, said inlet aperture having a diameter and said legs having a length wherein the length of said legs is related to the diameter of said inlet aperture such that a solid object that is small enough to pass beneath the bottom of said volute when said legs are resting on a flat surface can also pass through said inlet aperture; and further including a sprue molded with said volute that partially occludes said inlet aperture to restrict the size of solid object that can pass through said inlet aperture;

b) leaving said sprue in said inlet aperture; and c) cutting off said legs to a new length related to the diameter of a solid object that is small enough to pass through said inlet aperture as restricted by said sprue, such that a solid object that can pass beneath the bottom of said volute when said legs having said new length are resting on a flat surface can also pass through said inlet aperture and sprue.

3. A method of resizing a volute for a sewage pump comprising the steps of:

a) molding at least a portion of said volute as an integral piece including a bottom, an inlet aperture through said bottom, and a plurality of legs extending from said bottom, said inlet aperture having a diameter and said legs having a length wherein the length of said legs is related to the diameter of said inlet aperture such that a solid object that is small enough to pass beneath the bottom of said volute when said legs are resting on a flat surface can also pass through said inlet aperture; and b) resizing said volute by inserting an annular reducer in said inlet aperture to reduce the diameter thereof to a new diameter, and by cutting off said legs to a new length related to the new diameter of said inlet aperture such that a solid object that is small enough to pass beneath the bottom of said volute when said legs having said new length are resting on a flat surface can also pass through said inlet aperture in which said annular reducer is received.

* * * * *